United States Patent [19]

Brown

[11] 4,216,596

[45] Aug. 12, 1980

[54] PERPETUAL CALENDAR

[76] Inventor: Elmer L. Brown, 844 Jackson Hwy. South, Toledo, Wash. 98591

[21] Appl. No.: 959,790

[22] Filed: Nov. 13, 1978

[51] Int. Cl.[2] ..... G09D 3/00; G09D 3/10

[52] U.S. Cl. ..... 40/118; 40/110

[58] Field of Search ..... 40/118, 117, 116, 107, 40/110

[56] References Cited

U.S. PATENT DOCUMENTS

| | | | |
|---|---|---|---|
| 909,290 | 1/1909 | Hall | 40/117 |
| 968,363 | 8/1910 | Kendig | 40/118 |
| 1,235,442 | 7/1917 | Coppedge | 40/117 |
| 1,406,120 | 2/1922 | Waters | 40/118 |

FOREIGN PATENT DOCUMENTS

| | | | |
|---|---|---|---|
| 8670 | of 1915 | United Kingdom | 40/118 |

*Primary Examiner*—John F. Pitrelli

*Attorney, Agent, or Firm*—Klarquist, Sparkman, Campbell, Leigh, Hall & Whinston

[57] ABSTRACT

The specification discloses a perpetual monthly calendar in which numbered belts are adjustable to bring the numbers of a year to a year window, a month belt is adjustable to bring the month (with the number of days therein) to a month window, a day belt having six horizontal rows of numbers adjustable to bring the appropriate monthly calendar to a day window with the first of the month under the day of the week on which the month of a row of the days of the week is above the day window and exposing consecutive day numbers of that month in the day window. A sixth row pointer is adjustably positioned just beyond the last day of the month exposed when next day is in the sixth row. A fifth row pointer is adjustably positioned beyond the last day of the month exposed when the next day is in the fifth row.

2 Claims, 7 Drawing Figures

FIG.4
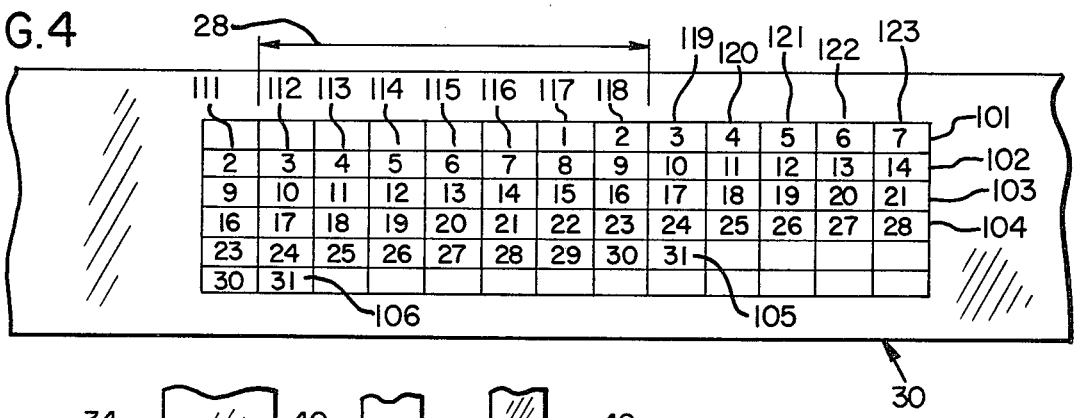
FIG.5
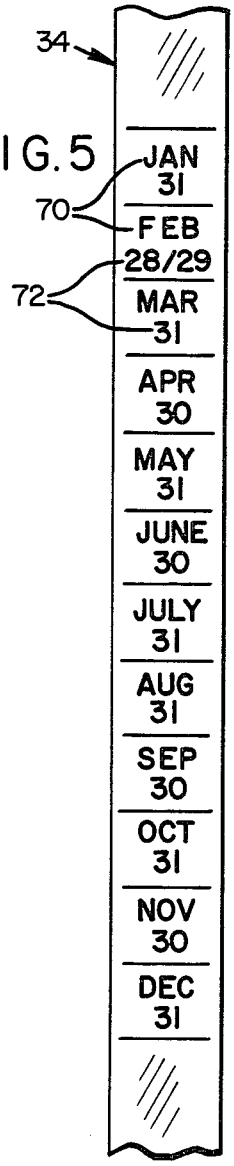
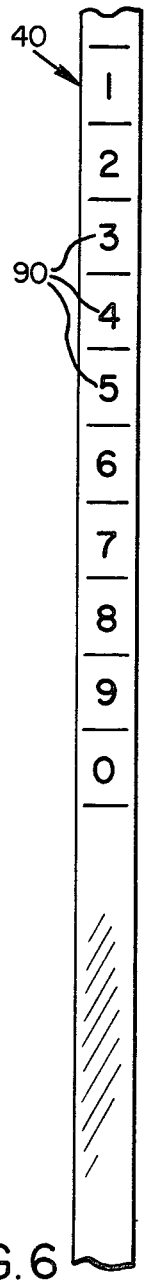
FIG.6
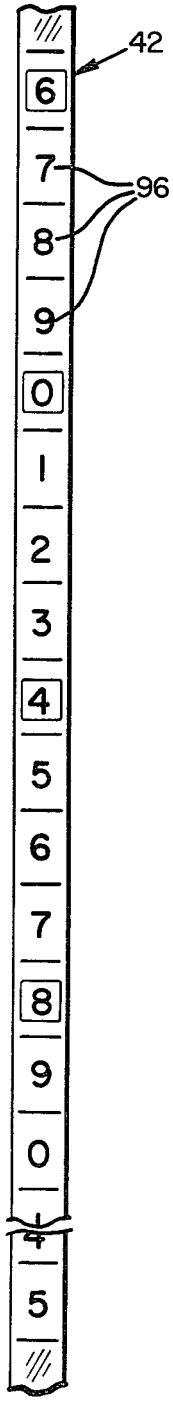
FIG.7

PERPETUAL CALENDAR

DESCRIPTION

This invention relates to a perpetual calendar, and has for an object thereof the provision of a perpetual calendar.

Another object of the invention is to provide a calendar that can be adjusted perpetually for each month and each year.

In the drawings:

FIG. 4 is an enlarged, fragmentary developed plan view of a belt of the calendar of FIG. 1 showing the days of months; and FIGS. 5, 6 and 7 are enlarged, fragmentary, developed plan views of a month belt, a decade belt and a year belt, repectively, of the calendar of FIG. 1.

Figure 1:
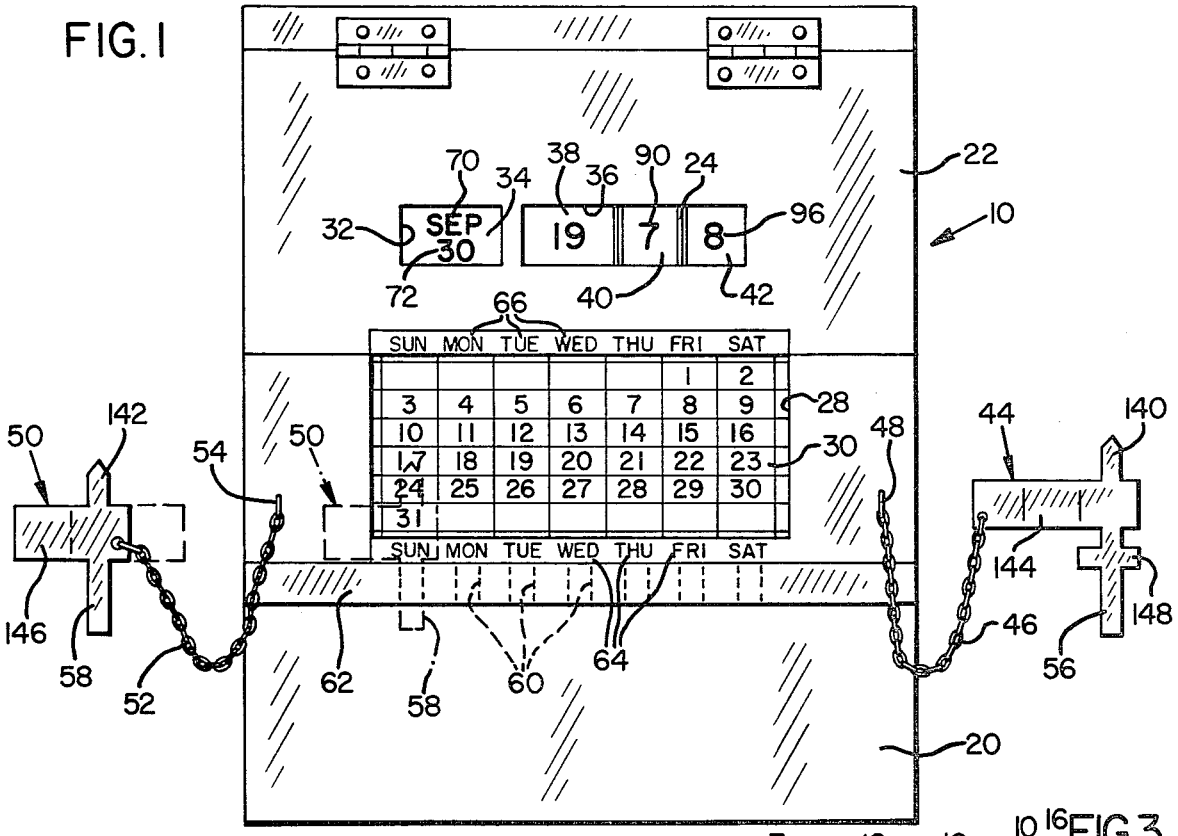
FIG. 1 is a top plan view of a perpetual calendar forming one embodiment of the invention.
Figure 2:
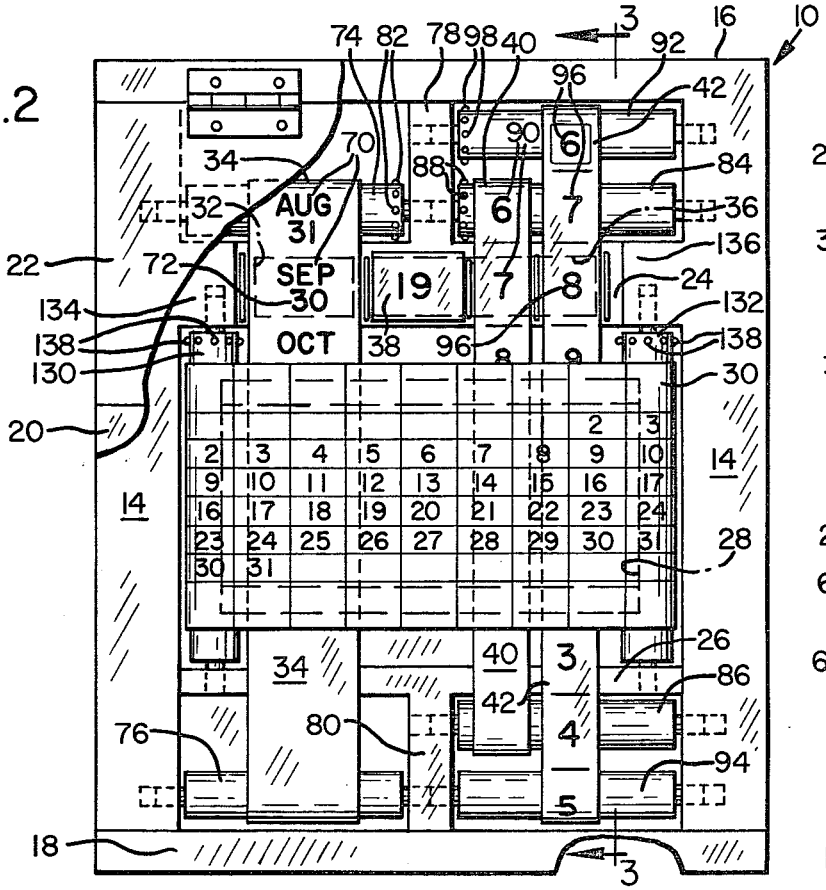
FIG. 2 is a view like FIG. 1 but with the cover broken away to show the operating mechanisms.
Figure 3:
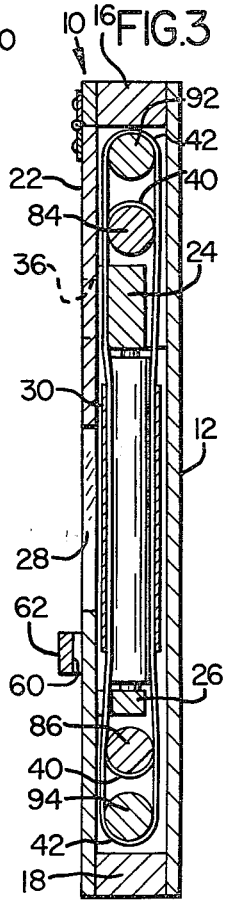
FIG. 3 is a vertical, sectional view taken along line 3—3 FIG. 2.

A perpetual calendar forming a specific embodiment of the invention includes a thin, box-like container 10 having a bottom 12, sides 14, upper and lower ends 16 and 18, a fixed lower cover 20 and a hinged, upper cover 22. These may be of wood, plastic or metal. Guides 24 and 26 are secured to the sides 14. The cover 20 has a large window 28 exposing a month portion of a day calendar belt 30, and the upper cover 22 has a month window 32 exposing a portion of a month belt 34 and a year window 36 exposing a century pad 38 and portions of a decade belt 40 and a year belt 42. A fifth row pointer 44 is secured to the container 10 by a chain 46 and an eye 48 screwed into the container 10 at the right side, and a sixth row pointer 50 is secured to the container by a chain 52 and an eye 54 screwed into the container at the left side. The pointers have tabs 56 and 58 adapted to be selectively inserted into slots 60 in a bar 62, the slots 60 being positioned below days-of-the-week-legends 64 on the cover 20 just below the window 28. Corresponding legends 66 are on the cover 22 just above the window 28.

The belts 30, 34, 40 and 42 are endless. The belt 34 has legends 70 indicating the months and legends 72 indicating the days of each month, and is mounted on rolls 74 and 76 journaled in aligned bores in one of the sides 14 and partition portions 78 and 80 of the ends 16 and 18. Pins 82 on the roll 74 are provided for manually turning the roll 80 to move the belt. Similarly, the belt 40 is mounted on rolls 84 and 86 journaled in bores in the portions 78 and 80 and the righthand side 14, the roll 84 having pins 88 for manually turning the roll 84. Legends 90 indicate the decade numbers. The belt 42 is mounted on rolls 92 and 94 journaled in bores in the side 14 and portions 78 and 80, and the belt 42 has legends 96 indicating the years of each decade. Pins 98 are provided for manually turning the roll 92.

The belt 30 has six horizontal rows 101 to 106 and thirteen vertical rows 111 to 123. The window 28 is of a width to expose only seven of the vertical rows 102 and of a height to expose all six horizontal rows 100. The seven righthand vertical rows 117 to 123 are exposed by the window 28 for all months starting on Monday. For Tuesdays, only rows 116 and 122 are exposed by the window, the row 123 being covered and the row 116 being identical in numbers to but being dropped down one horizontal row from the row 123. Similarly, for Wednesdays, the row 122 is covered and the row 115 is exposed and is indentical in numbers to the row 122 but dropped down one horizontal row. This same relationship is true of pairs of vertical rows 114 and 121; 113 and 120; 112 and 119 and 111 and 118. The belt 30 is mounted on rolls 130 and 132 journaled in aligned bores in pairs of bar portions 134 and 136 of the sides 14 and the guide 26. Pins 138 are provided on the rolls 130 and 132 for turning either roll to change the exposed portion of the belt 30.

The pointers 44 and 50 have pointer portions 140 and 142 adapted to point to the first day of the next month and have mask portions 144 and 146 to cover the numbers beyond the days of the month exposed. The pointer 44 has a stop 148 to hold the mask portion 144 up at the fifth row level. Only one of the pointers is used at one time, and the other is positioned at one side of the container 10.

The belt 42 has two decades, and each number divisible by four has an indentifying mark, e.g. an encircling square as shown or a different colored background identifying it as leap year to give the additional day in February.

What is claimed is:

1. In a perpetual calendar, a sheet-like member having six horizontal rows divided into thirteen vertical rows, the numbers 1 to 7 being placed in the end seven spaces at the right-hand portion of the top row, the numbers 2 to 14 being placed in the spaces of the second horizontal row, the numbers 9 to 21 being placed in the spaces of the third horizontal row, the numbers 16 to 28 being placed in the spaces of the fourth horizontal row, the numbers 23 to 31 being placed in the end nine spaces at the lefthand portion of the fifth horizontal row and the numbers 30 and 31 being placed in the end two spaces at the lefthand portion of the bottom horizontal row, a cover over the sheet-like member having an opening exposing only seven vertical rows and all horizontal rows and having legends of the days of the week adjacent the opening and over the seven exposed vertical rows, the member being adjustable horizontally relative to the cover to expose any desired consecutive seven vertical rows, the sheet-like member being a belt and including a pair of pulley means mounting the belt, hand pointer means adjustable on the cover to cover either the lowest row or the next to the lowest row and along the opening to indicate the day of the week of the first day of the next month, the pointer means including a pair of pointers, one for covering the lowest row and the other for covering the two lowermost rows.

2. The calendar of claim 1 including a year indicating belt means in which last digits of numbers divisible by four are marked to indicate leap years.

* * * * *